US008753173B2

(12) United States Patent
Linnenbruegger et al.

(10) Patent No.: US 8,753,173 B2
(45) Date of Patent: Jun. 17, 2014

(54) METHOD AND DEVICE FOR GRINDING THE MUTUALLY PARALLEL EDGES OF GLASS PLATES

(75) Inventors: Christoph Linnenbruegger, Bielefeld (DE); Joachim Korswird, Bramsche (DE); Martin Schnitker, Langenberg (DE)

(73) Assignee: Benteler Maschinenbau GmbH, Bielefeld (DE)

( * ) Notice: Subject to any disclaimer, the term of this patent is extended or adjusted under 35 U.S.C. 154(b) by 146 days.

(21) Appl. No.: 13/236,876

(22) Filed: Sep. 20, 2011

(65) Prior Publication Data

US 2012/0077421 A1 Mar. 29, 2012

(30) Foreign Application Priority Data

Sep. 24, 2010 (EP) ..... 10179267

(51) Int. Cl.
*B24B 55/08* (2006.01)
*B24B 55/02* (2006.01)

(52) U.S. Cl.
USPC ..... 451/5; 451/44; 451/194; 451/336; 451/449; 451/456

(58) Field of Classification Search
CPC ..... B24B 55/08; B24B 55/12; B24B 55/045; B24B 55/02; B24B 55/03
USPC ..... 451/44, 56, 53, 194, 336, 443, 488, 451/450, 5
See application file for complete search history.

(56) References Cited

U.S. PATENT DOCUMENTS

| | | | | |
|---|---|---|---|---|
| 5,755,614 | A * | 5/1998 | Adams et al. | 451/60 |
| 6,015,487 | A * | 1/2000 | Mori | 210/90 |
| 6,196,902 | B1 | 3/2001 | Gazca-Ortiz et al. | |
| 6,274,037 | B1 * | 8/2001 | Mori | 210/167.03 |
| 6,428,390 | B1 * | 8/2002 | Clark et al. | 451/11 |
| 6,461,228 | B2 * | 10/2002 | Stocker et al. | 451/44 |
| 6,524,173 | B1 * | 2/2003 | Nelson et al. | 451/178 |
| 6,604,984 | B2 * | 8/2003 | Gariglio | 451/5 |
| 6,645,043 | B1 * | 11/2003 | Yenawine | 451/5 |
| 6,685,541 | B2 * | 2/2004 | Brown et al. | 451/41 |
| 6,796,886 | B2 * | 9/2004 | Bushell | 451/182 |
| 7,001,249 | B1 * | 2/2006 | Pride et al. | 451/21 |
| 7,059,938 | B2 * | 6/2006 | Bando | 451/12 |
| 2002/0068514 | A1 * | 6/2002 | Margaria | 451/44 |
| 2003/0236060 | A1 | 12/2003 | Opfer et al. | |
| 2007/0141961 | A1 | 6/2007 | Brown et al. | |
| 2010/0178849 | A1 * | 7/2010 | Gobbi | 451/41 |
| 2011/0104988 | A1 | 5/2011 | Wenninger | |

FOREIGN PATENT DOCUMENTS

| | | |
|---|---|---|
| DE | 100 20 800 | 1/2001 |
| DE | 10 2008 027 050 | 12/2009 |

* cited by examiner

*Primary Examiner* — George Nguyen
(74) *Attorney, Agent, or Firm* — Michael J. Striker

(57) ABSTRACT

During grinding of mutually parallel edges of glass plates every edge of the glass plate is ground using a grinding tool or two grinding tools disposed one behind the other and cooling agent is directed from a side of the glass plate toward the grinding tool and supplied using a supply line divided via a redirection and separating segment into a plurality of fine streams of cooling agent, and a position of the grinding tool can be adjusted such that at least the position of the grinding tools relative to the assigned edge of the glass plate, which is passing through, is calibrated and the corners of the glass plate are ground to form a chamfer.

7 Claims, 5 Drawing Sheets

METHOD AND DEVICE FOR GRINDING THE MUTUALLY PARALLEL EDGES OF GLASS PLATES

CROSS-REFERENCE TO RELATED APPLICATION

The invention described and claimed hereinbelow is also described in European Patent Application 10 179 267.9 filed on Sep. 24, 2010. This European Patent Application, whose subject matter is incorporated here by reference, provides the basis for a claim of priority of invention under 35 U.S.C. 119(a)-(d).

BACKGROUND OF THE INVENTION

The invention relates to a method for grinding the mutually parallel edges of glass plates which can be transported past the rotatably driveable grinding tools in a continuous manner using a horizontal conveyor, wherein each grinding tool can be acted upon by a stream of cooling agent. The present invention also relates to a device for carrying out the method according to the invention.

Systems for grinding the edges of glass plates are known. In these systems, every edge of the glass plate is machined using at least three grinding tools disposed one behind the other. The structure of such a system is therefore relatively highly complex. The feed rate of the glass plate to be machined is relatively low due to the material, while the circumferential speeds of the grinding tools are relatively high. Due to the material, it is absolutely necessary to cool the grinding tools using a cooling agent during the grinding procedure. This cooling agent is supplied via a supply line, and the cooling agent is captured and prepared for further use.

The flat surfaces which determine the thickness of the glass plate are of particularly high quality and are provided with a coating of a high-quality material depending on the intended use. Due to the method used so far to supply cooling agent, cooling agent is unavoidably sprayed onto these flat surfaces. This results in an impairment of the surface and the coating, and rework is therefore required.

In the case of the systems known so far, the structure is highly complex since it comprises three grinding tools disposed one behind the other, and rework is required to attain the surface quality of the surface or the coating that determines the thickness of the glass plate.

SUMMARY OF THE INVENTION

The problem addressed by the invention is that of providing a method of the type described in greater detail above, which, when implemented, results in minimal structural complexity of a system, and the glass plates that were machined have a surface quality that meets the requirements without rework. Another problem addressed by the invention is that of providing a device that operates according to the method according to the invention, in which, at the least, the structural complexity in respect to the placement of the grinding tools is reduced, and is designed such that the flat surfaces and coatings remain free of cooling agent during the grinding procedure.

The problem directed to the method is solved in that every edge of the glass plate is ground using one grinding assembly or two grinding assemblies disposed one behind the other as seen in the direction of conveyance of the glass plates, the cooling agent stream is directed from the side of the glass plate to the grinding tool, the cooling agent stream is divided into a large number of fine streams of cooling agent, and the cooling agent can be suctioned off using cooling agent suction lines connected to a vacuum source, wherein the fine streams of cooling agent are directed to the cooling agent suction line, the position of each grinding tool is determined—in respect to height—using a tool measurement device and the diameter of the grinding tool is detected, and, at the least, the position of each grinding tool with respect to the edge of the glass plate to be machined can be controlled such that, at the least, the position of each grinding tool relative to the assigned edges of the glass plate, which is passing through, is calibrated, and the corners of the glass plate are ground to form a chamfer.

The structural complexity of a device that operates according to the method according to the invention is already simplified in that the number of grinding assemblies is reduced to two units, wherein it is preferable for each edge to be machined using a single grinding assembly.

Since the cooling agent stream is now directed from the side of the glass plate to the grinding tool, cooling agent is effectively prevented from being sprayed onto the flat sides of the glass plate. By dividing the cooling agent stream into a large number of fine streams of cooling agent, the cooling agent is distributed in an optimal manner, thereby cooling the grinding tool in the best manner possible.

Since the cooling agent can now be suctioned away using the cooling agent suction lines connected to the vacuum source, wherein the strength of the vacuum and the diameter of the suction line are coordinated with one another such that the cooling agent travels only in the direction of the suction line, spraying onto the flat sides of the glass plate is effectively prevented.

Since the position of each grinding tool is now determined with respect to height, and the diameter of the grinding tool is ascertained, the edge can be machined using a single grinding tool since the position of the circumferential surface of the grinding tool relative to the edge does not change, and readjustment can therefore be carried out during the grinding procedure. This procedure is referred to as calibration. Due to the calibration and the detection of the height of the grinding tool, a chamfer having a smooth surface can be ground while coordinating the feed rate of the glass plate with the advance movement of the grinding tool.

By grinding the chamfers in the corner regions of the glass plates, an additional working step is prevented, thereby increasing the cost effectiveness of a system that operates according to the method according to the invention.

In a further embodiment, the flow of aspirated air is so intensive that the centrifugal force of the grinding tool during the grinding procedure is overcome, and therefore open space for the air is created.

This open space causes an air bubble to form, thereby enabling the cooling agent to flow into this open space continuously, which prevents the cooling agent from reaching the flat sides of the glass plate.

It is furthermore advantageous for the method according to the invention for the grinding tool to be transferred into the target state using a grinding device assigned to the grinding tool, i.e. the grinding tool, using a grinding disk, is machined on the circumferential surface, thereby eliminating the changes in the circumferential surface resulting from wear, i.e. the surface quality of the circumferential surface of the grinding disk is constantly optimized.

The problem directed to the device for grinding the mutually parallel edges of glass plates, in particular for performing the method, wherein the device comprising a horizontal conveyor which transports the glass plates is equipped with diametrically opposed grinding tools, each of which can be driven in a rotating manner by a drive, and which is equipped with a cooling agent supply line for cooling each grinding tool, is solved by equipping the device on each side of the edges—to be ground—of the glass plate, which is passing through, with one or two grinding assemblies which are disposed one behind the other in the direction of conveyance of the glass plates, and which are equipped with a rotatably driveable grinding tool, assigning a lateral cooling agent supply line and, situated at a distance therefrom, a cooling agent suction line to each grinding tool, and redirecting and dividing the supplied stream of cooling agent in the direction toward the grinding tool using a redirection and stream-dividing segment.

Structural complexity is reduced in the case of the device by machining each edge of the glass pane using a maximum of two grinding tools, although preferably using one grinding tool. This is made possible by way of the assemblies described below. In respect of the device it is essential, however, for the cooling agent supply line to pass by the grinding disk or the grinding tool on the side, and, using the redirection and stream-dividing segment, for the stream of cooling agent to the redirected in the direction toward the grinding tool and divided in such a manner that the grinding disk or the grinding tool is enclosed in a semicircular manner, thereby enabling cooling agent to be supplied across an angle that can be in the range of 180°.

In order to replace the grinding tool or the grinding disk as quickly as possible when necessary, each grinding tool is secured on the rotatably driveable grinding spindle using a clamping device, and each grinding tool is disposed in a multi-component housing, wherein the individual housing parts are disposed one above the other, preferably three housing parts are provided, and the grinding tool is assigned to the middle housing section, the upper housing section is stationary, and the lower housing part can be swivelled about a vertical axis to permit removal of the grinding tool that has been released from the grinding spindle, and the redirection and stream-dividing segment is disposed in the middle housing part, or the redirection and stream-dividing segment forms the middle housing part.

The upper housing part assigned to the drive of the grinding tool is used, for example, to support the grinding spindle in the immediate vicinity of the grinding tool. When the grinding tool rotates in the middle housing part, and this housing part contains the redirection and stream-dividing segment or is in the form of a redirection and stream-dividing segment, then the stream of cooling agent is guided in an optimal manner and structural complexity is minimized.

Since the lower housing part facing away from the drive of the grinding tool can swivel about the vertical axis, the grinding tool—after having been released from the grinding spindle—enters this housing part and can be removed manually. The clamping device is designed such that the grinding tool can be released or unlocked from the outside.

To ensure that the cooling agent to be suctioned off is suctioned exclusively in the direction toward the suction line, the housing part assigned to the grinding tool on the housing part assigned to the vacuum source increases the cross section of this direction on the side assigned to the vacuum generator. As a result, the centifugal force of the grinding tool can be overcome by the vacuum.

The end of this housing part assigned to the vacuum source is in the form of a flange for connection to the cooling agent suction line.

When the edges of the glass plate are ground, grindings are produced which have a relatively small particle size, although the hardness of these grindings is particularly high. To remove these grindings, a separator for removing solid particles is provided between the vacuum generator and the cooling agent suction line. It is also provided that the cross section of the cooling agent suction line is greater than the cross section of the cooling agent supply line. In addition, cooling agent is also prevented from reaching the glass plate to be machined.

In the case of the device under discussion, various assemblies must be adjusted along the width of the glass plates that are passing through. Therefore, the device comprises a stationary portal as the support frame for the horizontal conveyor at least, a support strip located in the center and underneath the plane of passage of the glass plates and comprising the grinding assemblies having the grinding tools, and an actuator drive for the support strip.

In order to securely guide the glass plates during the grinding procedure, the horizontal conveyor is composed of two suction belt conveyors which are situated at a distance from the assigned edge of the glass plate and are connected to at least one vacuum source, and at least one suction belt conveyor and at least one grinding assembly can be adjusted using an actuator drive.

A structurally simple solution for an actuator drive of the support strip is given when it is effective transversely to the conveyance direction of the suction belt conveyor, and when the actuator drive contains two interspaced adjustment belts.

The adjustment path of the central support strip can be adjusted in a particularly simple manner when each adjustment belt is composed of two individual interspaced belts, the return rollers of each adjustment belt have different diameters such that the circumferential speed of one of the individual belts is twice as great as that of the other individual belt.

The conveyor belt having the greater speed could be considered the drive belt, and the conveyor belt having the lower circumferential speed could be considered the adjustment belt for the suction belt conveyor and, possibly, for the grinding assembly.

As is known, glass is a material having extremely great hardness. Appropriate grinding tools are therefore required. Due to the hardness of glass, however, the circumferential surface of the grinding tool will inevitably become worn. However, since the edges to be machined must have a high surface quality, a sharpening device is assigned to each grinding tool such that the circumferential surface of the grinding disk or the grinding tool can be considered a smooth surface. The advantage is that no deinstallation is required in order to sharpen the grinding tool. The sharpening of the grinding tool is also referred to as truing. The invention will be explained in greater detail with reference to the attached drawings.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
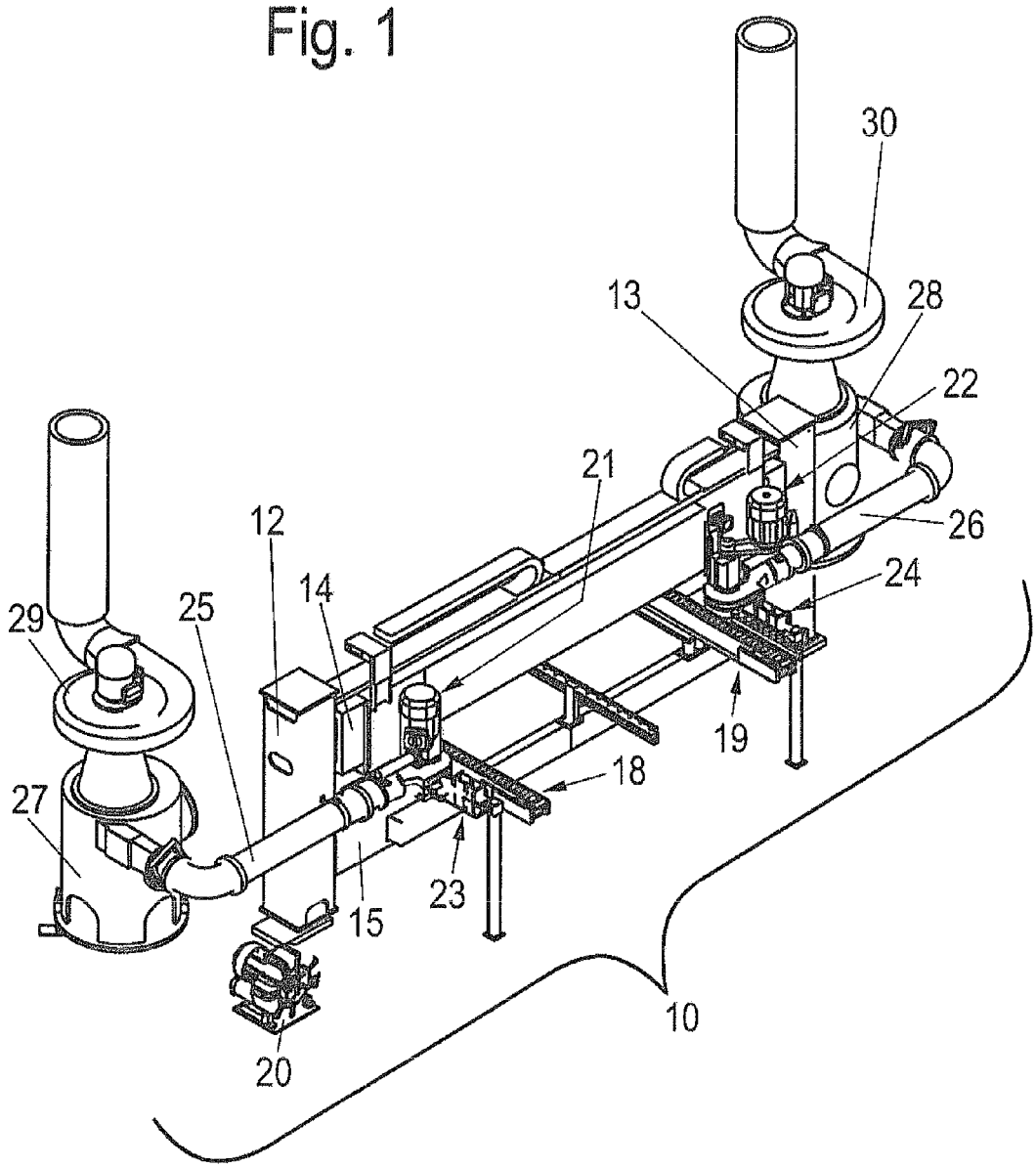
FIG. 1 shows a partial view of a system according to the invention for grinding the edges of glass plates, showing the grinding station having two grinding assemblies in a perspective depiction.
Figure 2:
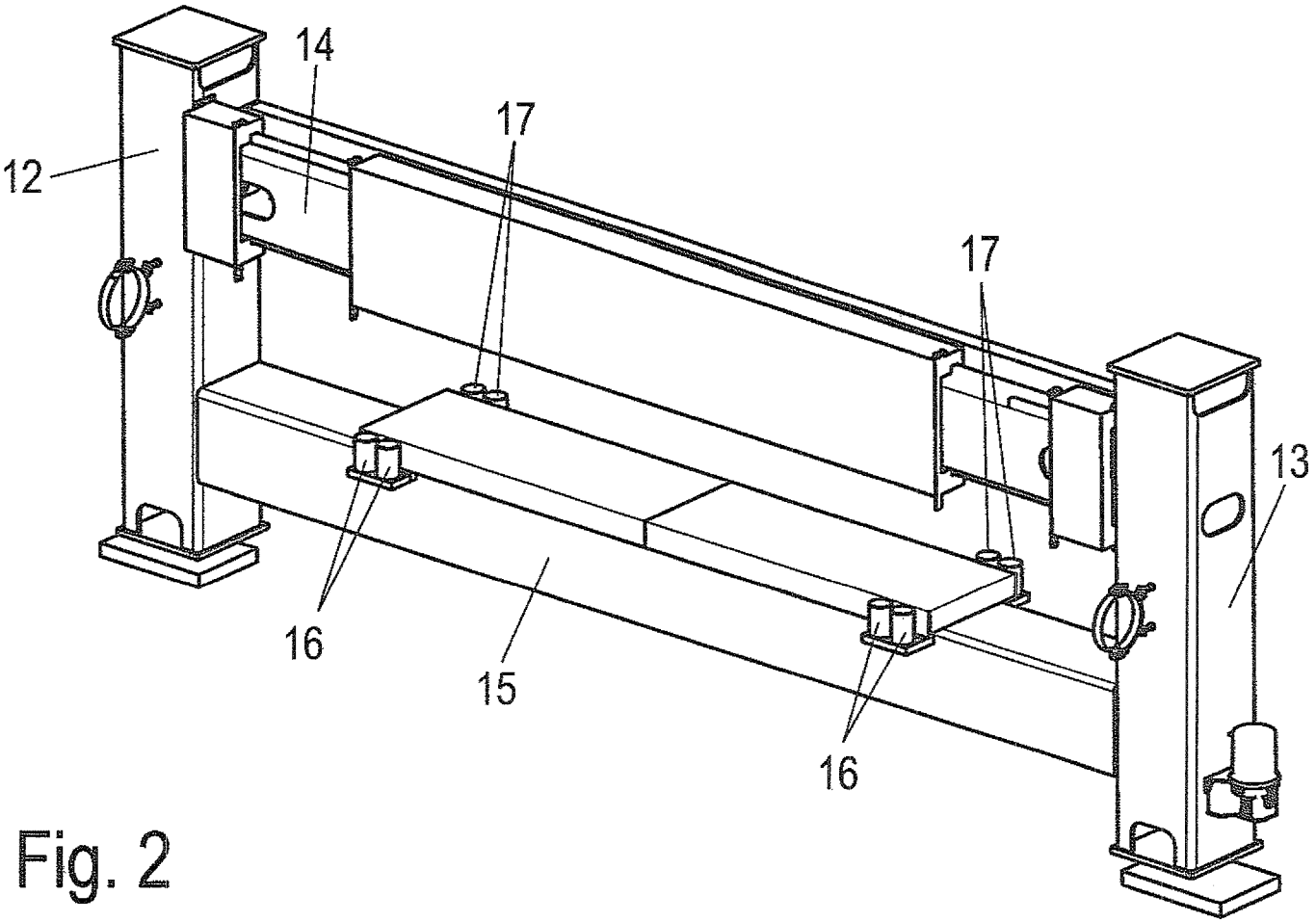
FIG. 2 shows the portal of the device according to FIG. 1 as an isolated component, in a perspective depiction.

For simplicity, a complete system for grinding the diametrically opposed edges of glass plates is not depicted in the figures. FIG. 1 shows grinding station 10, in a perspective and simplified depiction. Grinding station 10 contains a portal frame 11 which is depicted in greater detail as an isolated component in FIG. 2. Portal frame 11 is composed substantially of two laterally and vertically extending columns 12, 13, an upper carriage guide 14, and a crossmember 15 which extends transversely to columns 12, 13. Return rollers 16, 17 disposed in pairs are assigned to crossmember 15, via which conveyor belts (not depicted) are guided. Return rollers 16, 17 are part of an actuating drive (not depicted) for suction belt conveyors 18, 19 which affix the glass plates. Suction belt conveyors 18, 19 are known per se and comprise a suction box which is connected to a vacuum source 20. To transport the glass plates (not depicted), each suction belt conveyor 18, 19 is equipped with a perforated conveyor belt shown as an example.

Figure 3:
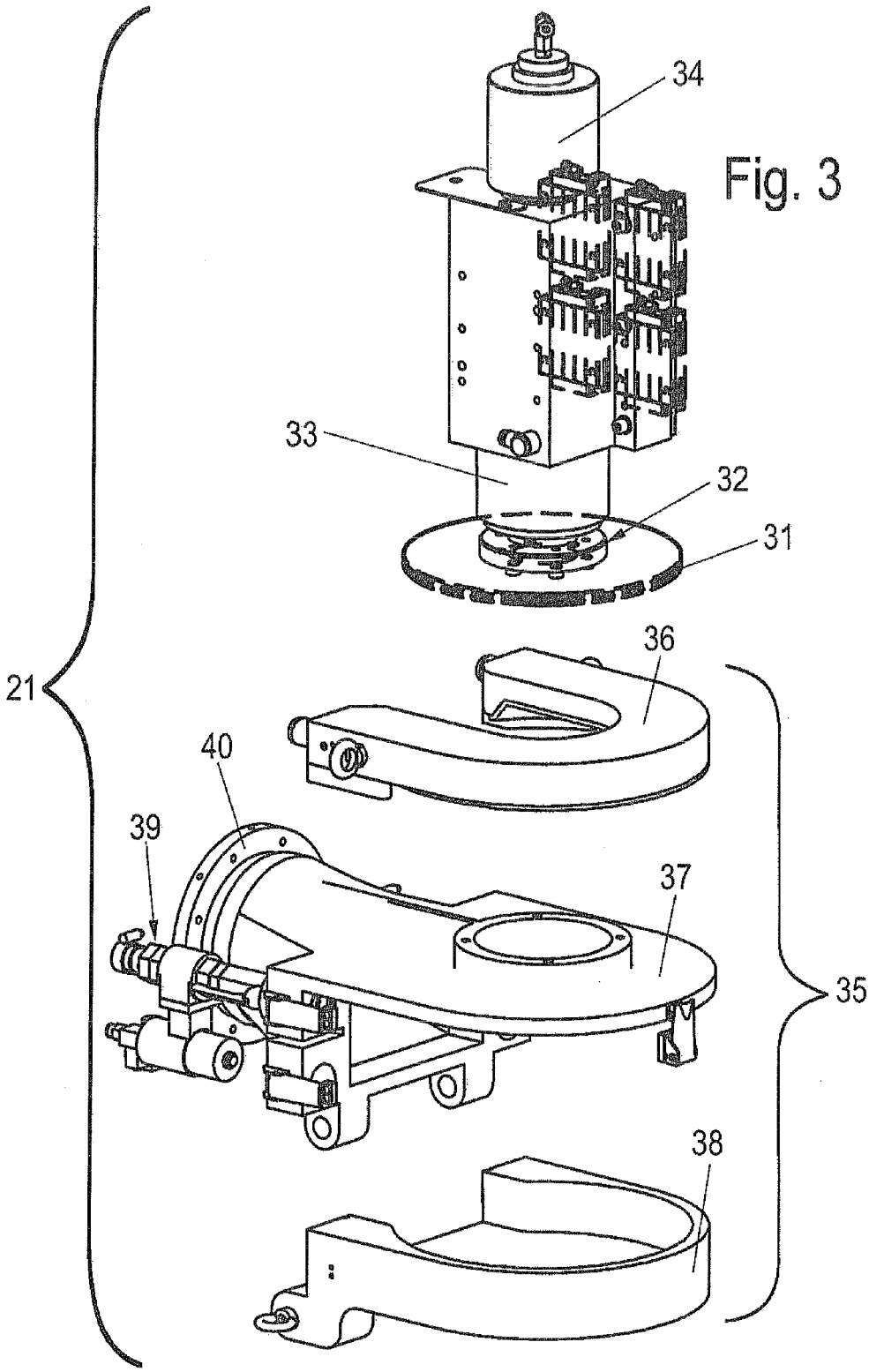
FIG. 3 shows the grinding assembly equipped with the grinding tool, and the housing assigned to the grinding tool, in an exploded depiction.

Grinding station 10 contains two grinding assemblies 21, 22 which will be explained in greater detail with reference to FIG. 3, are situated at a distance from suction belt conveyors 18, 19, and are adjustably disposed on the sides of suction belt conveyor 18, 19 facing each other. Each grinding assembly 21, 22 is equipped with a sharpening device 23, 24 in order to machine the grinding tool of the grinding assembly 21, 22 after a certain amount of wear has occurred.

A cooling agent suction line 25, 26 is connected to each grinding assembly 21, 22, each of which is in the form of a cooling housing and leads into a separator 27, 28 (not depicted). Separators 27, 28 are used to remove the solid particles from the cooling agent. Every separator 27, 28 is connected in a conducting manner to a vacuum generator 29, 30. From there, the cooling agent is directed into a cooling agent container (not depicted), and is used for further cooling of the grinding tools.

Figure 4:
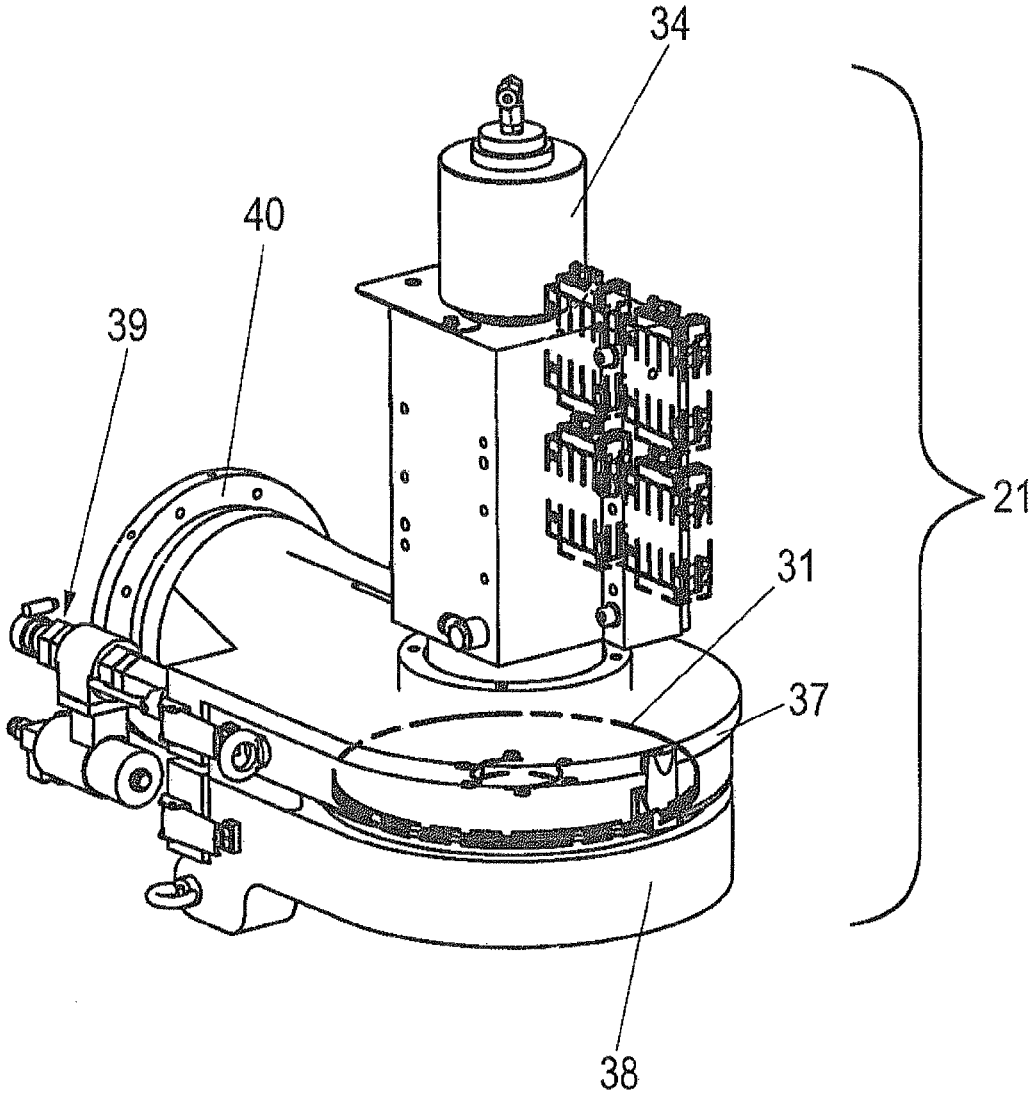
FIG. 4 shows a depiction which corresponds to FIG. 3, although in an assembled state.

FIGS. 3 and 4 each show, in perspective depictions, the left grinding assembly 21 based on the depiction according to FIG. 1. Grinding assembly 22 on the diametrically opposed right side is designed as a mirror image thereof. Grinding assembly 21 contains a grinding tool 31 in the form of a grinding disk which is mounted on grinding spindle 33 using a clamping device 32 (not depicted). A pulley 34 is mounted on the diametrically opposed end of grinding spindle 33, thereby enabling grinding spindle 33 to be driven via a belt (not depicted) and a motor.

Grinding tool 32 is located inside a housing 35 which, in the embodiment shown, is composed of an upper housing part 36 facing grinding spindle 33, a middle housing part 37, and a lower housing part 38 facing away from grinding spindle 33. Housing parts 36 and 38 are open in the direction toward cooling agent suction line 25. As shown in FIG. 4 in particular, grinding assembly 21 is designed such that grinding tool 31 rotates in the transition region between middle housing part 37 and lower housing 38.

The segment facing away from cooling agent suction line 25, or the curved end region of middle housing part 37 is in the form of a redirection and stream-dividing segment, and is closed to the outside. Housing part 37 is equipped with a connector 39 for the cooling agent supply line (not depicted). The inflowing cooling agent stream impacts the . . . facing away from cooling agent suction line 25 and is redirected and divided. This end region of housing part 37 is provided with an inner ring comprising a large number of bores having a relatively small diameter. Several individual streams are directed to grinding tool 31 through these bores. Middle housing part 37 is connected via a flange 14 to cooling agent suction line 25. The region between grinding tool 31 and flange 40 is in the form of a cooling housing and expands via the cross section thereof in the direction toward flange 40.

Lower housing part 38 can swivel about a vertical axis. When grinding tool 31 is released from grinding spindle 33 after actuation of clamping device 32, lower housing part 38 can be swivelled, and the grinding tool can be removed. Therefore, no assembly work is required to replace grinding tool 31.

FIG. 4 shows grinding assembly 21 in the assembled state. The position of grinding tool 31 is shown clearly. The figure also shows that grinding assembly 21 is extremely compact. The figure also shows that upper housing part 36 lies inside middle housing part 37.

Figure 5:
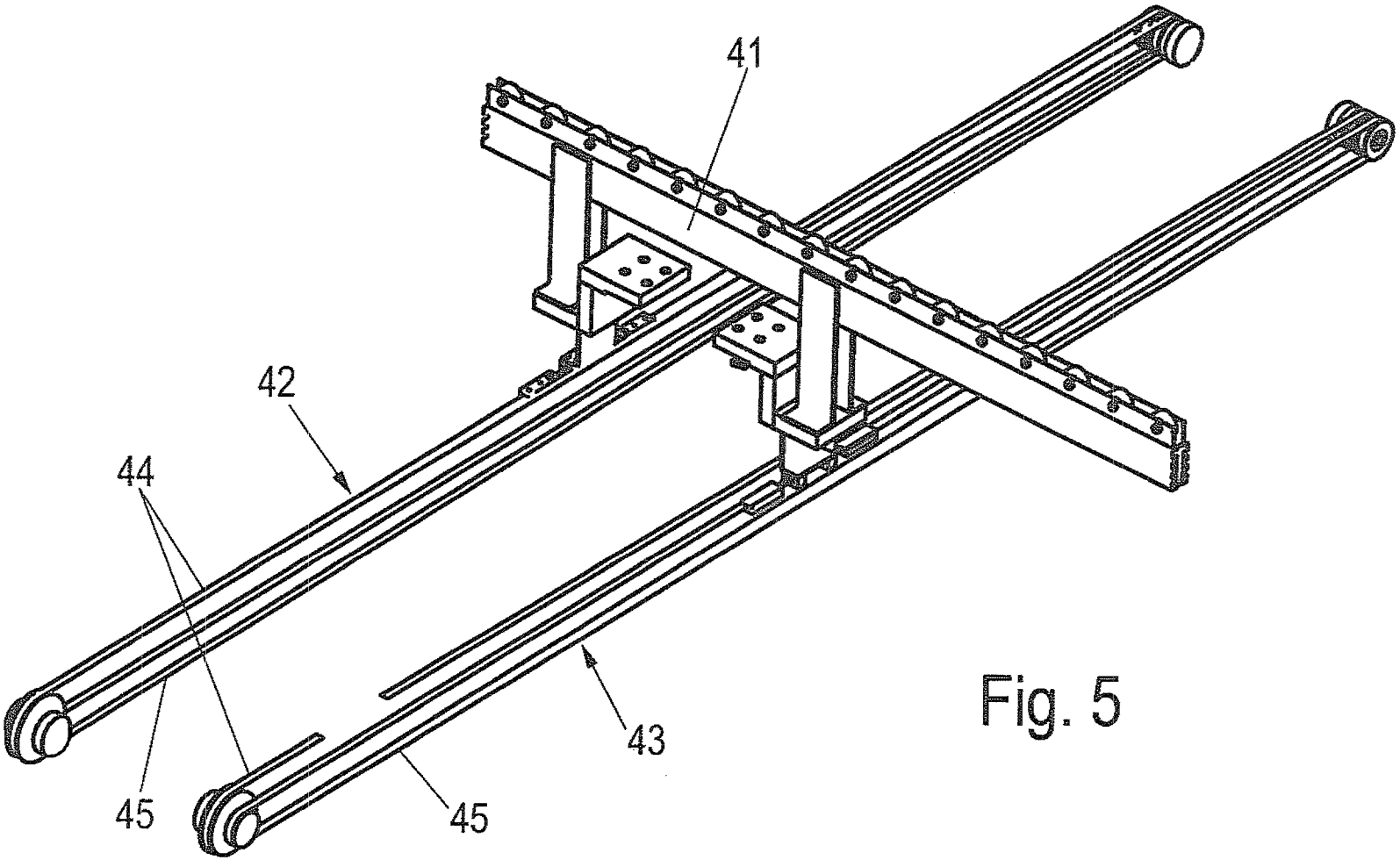
FIG. 5 shows the actuator drive for adjusting the suction belt conveyor, as an isolated component, in a perspective depiction.

FIG. 5 shows, in combination with FIG. 1, that a support strip 41 is always provided in the center between moveable suction belt conveyors 18, 19, and is located underneath the plane of passage of the glass plates to be machined. Two adjustment belts 42, 43 which operate transversely to support strip 41 and suction belt conveyors 18, 19 are provided transversely to support strip 41. Adjustment belts 42, 43 form an actuating drive for support strip 41. Adjustment belts 42, 43 are driven by suction belt conveyor 18, 19, thereby moving support strip 41. Each adjustment belt 42, 43 is composed of two individual belt drives 44, 45, whereby the return rollers are matched to one another in terms of the diameter such that the circumferential speed of individual belt 45 is 50% that of the circumferential speed of individual belt 44. As a result, support strip 41 is moved at half the drive speed. Since individual belts 44, 45 move at half the speed of adjustment belts 42, 43 due to the smaller diameter of the return rollers, support strip 41 is also moved at half the speed of suction belt conveyors 18 or 19, and therefore support strip 41 is always located in the center between suction belt conveyors 18, 19.

The present invention is not limited to the embodiment shown. Is essential that, according to the method, the cooling agent stream is redirected via a redirection and stream-dividing element such that it impacts grinding tool 31 from the side of the glass plate, wherein this cooling agent stream is advantageously divided into a large number of individual streams. It is furthermore significant that every glass edge is machined by a maximum of two grinding assemblies 21, 22, but preferably always by only one grinding assembly, and that the feed rate of the glass plate and the advance movement of each grinding assembly 21, 22 are coordinated with one another such that a chamber having a smooth surface can be ground in the corner regions of the glass plate.

It will be understood that each of the elements described above, or two or more together, may also find a useful application in other types of methods and constructions differing from the types described above.

While the invention has been illustrated and described as embodied in a method and device for grinding the mutually parallel edges of glass plates, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

The invention claimed is:

1. A device for grinding mutually parallel edges of glass plates, comprising:

a horizontal conveyer transporting the glass plates;

diametrically opposed grinding tools each driven in a rotated manner by a drive; a cooling agent supply line for cooling each of the grinding tools; and, on each side of an edge of a glass plate to be ground, one grinding assembly or two grinding assemblies disposed one behind the other in a direction of conveyance of the glass plates, wherein said grinding assemblies are provided with a rotatably driveable grinding tool;

a lateral cooling agent supply line and, situated at a distance therefrom, a cooling agent suction line assigned to each of the grinding tools;

a redirection and stream-dividing segment which redirects and divides a supplied stream of cooling agent in a direction toward the grinding tool;

a vacuum source, wherein the housing part assigned to the grinding tool is disposed on a side facing said vacuum source and has an enlarging cross section; and a separator for removing solid particles, provided between said vacuum source and the cooling agent suction line, and wherein a cross section of the cooling agent suction line is greater than a cross section of the cooling agent supply line.

2. The device as defined in claim 1, wherein each of the grinding tools is secured on a rotatably driveable grinding spindle using a clamping device, and within a multi-component housing with individual housing parts disposed one above the other, wherein the grinding tool is assigned to a middle one of the housing parts, an upper one of the housing parts is stationary, and a lower one of the housing parts is swivellable about a vertical axis to permit removal of the grinding tool that has been released from the grinding spindle, and wherein the redirection and stream-dividing segment is disposed in the middle housing part or forms the middle housing part.

3. The device as defined in claim 1, further comprising a stationary portal for the horizontal conveyor and a support strip located in a center and underneath a plane of passage of the glass plates, wherein the support strip includes the grinding assemblies having the grinding tools, and an actuator drive for the horizontal conveyor.

4. The device as defined in claim 1, wherein the horizontal conveyor is composed of two suction belt conveyors situated at a distance from an assigned edge of the glass plate and connected to at least one vacuum source, and wherein at least one of the belt conveyors and at least one of the grinding assemblies is adjustable parallel and at a distance by an actuator drive.

5. The device as defined in claim 3, further comprising an actuator drive adjusting the support strip transversely thereto and composed of two interspaced adjustment belts.

6. The device as defined in claim 5, wherein each of the adjustment belts is composed of two interspaced individual belts, and wherein the adjustment belts have return rollers with different diameters such that a circumferential speed of one of the individual belts is twice as great as a circumferential speed of the other of the individual belts.

7. The device as defined in claim 1, further comprising a sharpening device assigned to each of the grinding tools and operating to provide a smooth circumferential surface of the grinding tools.

* * * * *